US010517150B1

(12) United States Patent
Zhen

(10) Patent No.: US 10,517,150 B1
(45) Date of Patent: Dec. 24, 2019

(54) CONTROL METHOD FOR SIGNAL TRANSMISSION THROUGH VOLTAGE BOOSTING, AND APPLICATION CIRCUIT THEREFOR

(71) Applicant: JIANGMEN PENGJIANG TIANLI NEW TECH CO., LTD., Jiangmen, Guangdong (CN)

(72) Inventor: Zhaowei Zhen, Guangdong (CN)

(73) Assignee: JIANGMEN PENGJIANG TIANLI NEW TECH CO., LTD., Jiangmen (CN)

( * ) Notice: Subject to any disclaimer, the term of this patent is extended or adjusted under 35 U.S.C. 154(b) by 0 days.

(21) Appl. No.: 16/374,755

(22) Filed: Apr. 4, 2019

(30) Foreign Application Priority Data

Feb. 18, 2019 (CN) ..... 2019 1 0123492

(51) Int. Cl.
*H05B 33/08* (2006.01)

(52) U.S. Cl.
CPC ..... *H05B 33/0809* (2013.01); *H05B 33/0845* (2013.01)

(58) Field of Classification Search
None
See application file for complete search history.

(56) References Cited

U.S. PATENT DOCUMENTS

2018/0263095 A1* 9/2018 Wray ..... H05B 37/0245

* cited by examiner

*Primary Examiner* — Dedei K Hammond

(57) ABSTRACT

A control method for signal transmission through voltage boosting and an application circuit therefor, wherein the control method comprises: performing voltage boosting processing on an input low-voltage signal by a supply voltage processing circuit, a low-voltage signal processing circuit and a modulation processing circuit, and outputting a high-voltage LED signal; and receiving the high-voltage LED signal by a high-voltage LED signal output circuit, performing high-voltage signal processing on the high-voltage LED signal by a high-voltage LED signal processing circuit, and outputting a control signal and a power supply which are mutually independent. The present invention increases the intensity and distance of signal propagation by performing voltage boosting processing on signals and then controlling LED lamp strings by the high-voltage LED signal processing circuit.

8 Claims, 3 Drawing Sheets

CONTROL METHOD FOR SIGNAL TRANSMISSION THROUGH VOLTAGE BOOSTING, AND APPLICATION CIRCUIT THEREFOR

CROSS REFERENCE TO RELATED APPLICATIONS

The present application claims the benefit of Chinese Patent Application No. 201910123492.6 filed on Feb. 18, 2019, the contents of which are incorporated herein by reference in their entirety.

TECHNICAL FIELD

The present invention relates to the technical field of LED lamp control, and in particular to a method for signal transmission through voltage boosting, and an application circuit therefor.

BACKGROUND ART

With the continuous development of society, LED lamps are now broadly used. An existing LED lamp string has a low voltage and a small current which cannot be directly used to drive the LED lamp string, and the LED lamp string in use has to work in cooperation with an additional input DC power supply and LED signal to display a colorful effect.

However, the additional DC power supply has a relatively low voltage, which is usually the voltage across a battery pack, i.e. a common voltage of 5 V or 7 V. After the voltage output by such a conventional battery is aggregated with the LED signal, it is incorporated into a controller for the LED lamp string to control the light emission of lamp beads on the lamp string. In a lamp string in an individual branch, there are many small lamp beads connected in series. Therefore, in a trunk power line for the LED lamp string controller and small lamp beads, there will be loss of signal transmission due to too low voltage, and some of the lamp beads only emit light without gorgeous change effect.

SUMMARY OF THE INVENTION

In view of the defects in the prior art mentioned above, the technical problem to be solved by the present invention is to provide a method for signal transmission through voltage boosting and an application circuit therefor which can make the effect of light emission of the lamp string more stable.

In order to solve the above technical problems, the technical solutions of the present invention are as follows:

A control method for signal transmission through voltage boosting, comprising:

step S1, processing an input low-voltage signal by a low-voltage signal processing circuit, and outputting a low-voltage control signal to a modulation module; and performing voltage processing on an input power supply by a supply voltage processing circuit, and outputting two sets of DC power supplies having voltage difference therebetween to the modulation module;

step S2, modulating, by the modulation module, the low-voltage control signal and the two sets of DC power supplies having voltage difference therebetween to generate a high-voltage LED signal of which the voltage is higher than that of the low-voltage signal; and step S3, performing high-voltage signal processing on the high-voltage LED signal by a high-voltage LED signal processing circuit, and outputting a control signal and an LED power supply which are mutually independent.

Furthermore, in the step S3, the high-voltage LED signal processing circuit performs demodulation processing on the high-voltage LED signal, and then outputs the LED control signal and the LED power supply.

An application circuit for signal transmission through voltage boosting so as to control the light emission of a lamp string, the application circuit comprising:

a voltage processing circuit for receiving a power supply input signal, and performing voltage processing on the power supply input and outputting a first DC power supply and a second DC power supply;

a low-voltage signal processing circuit for receiving a low-voltage signal, and processing the low-voltage signal and outputting a low-voltage control signal;

a modulation module electrically connected to the supply voltage processing circuit and the low-voltage signal processing circuit, respectively, for modulating the low-voltage control signal and the first and second DC power supplies into a high-voltage LED signal; and a high-voltage LED signal processing circuit electrically connected to the modulation module, for performing demodulation processing on the high-voltage LED signal, and outputting an LED control signal and an LED power supply which are mutually independent.

Furthermore, voltages of the first DC power supply and the second DC power supply are different.

Furthermore, the signal characteristics of the high-voltage LED signal are the same as those of the low-voltage signal.

Furthermore, the high-voltage LED signal processing circuit comprises a demodulation module, a voltage processor, a signal processor and a controller, wherein the demodulation module is electrically connected to and in cooperation with the modulation module and separates the high-voltage LED signal into an LED power supply and an LED control signal, the LED power supply being processed by the voltage processor and then entering into the LED controller, and the LED control signal being processed by the signal processor and then entering into the LED controller to control the change in light emission of LED lamps.

Furthermore, the high-voltage LED signal processing circuit is packaged in an LED module or integrated in an integrated circuit.

Furthermore, a plurality of the LED modules are connected in series or in parallel to form a lamp string.

The present invention provides a control method for signal transmission through voltage boosting, wherein a high-voltage LED signal is formed by aggregating high and low-voltage levels having voltage difference therebetween, which are generated through processing by a supply voltage processing circuit on AC power output from the mains supply, with a low-voltage signal, and is directly output to a high-voltage LED signal processing circuit for controlling the light emission of lamp beads.

Compared with the prior art, the present invention has the following advantages:

I. a signal in a low-voltage signal processing circuit has been loaded at a power supply input end, unlike the traditional DC low-voltage control method at a controller end;

II. the advantage of high voltage LED signal transmission is that some of external wiring can be eliminated, thereby saving wires and reducing the difficulty of construction; and III. the transmission distance of high-voltage LED signal transmission is greater, the length of the lamp string bus can be greater so as to access to more lamp strings, and the signal is more stable.

Figure 1:
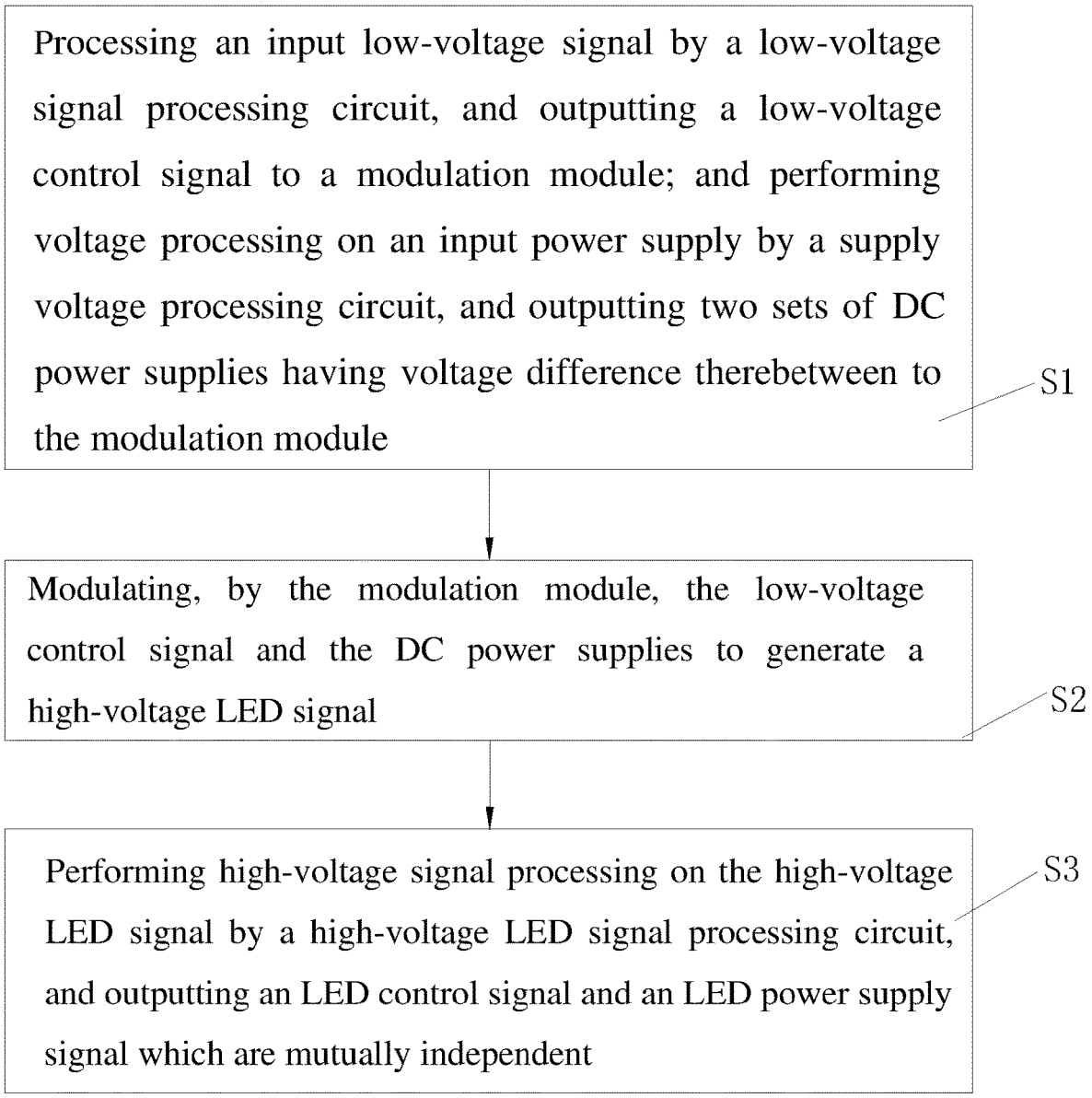
FIG. 1 is a flowchart of a control method for signal transmission through voltage boosting in accordance with an embodiment of the present invention.

In the drawings: 1—Supply voltage processing circuit, 2—Low-voltage signal processing circuit, 3—Modulation module, 4—High-voltage LED signal processing circuit, 5—LED module, 41—Demodulation module, 42—Voltage processor, 43—Signal processor, and 44—Controller.

DETAILED DESCRIPTION OF EMBODIMENTS

The detailed description of the present invention is further described below in combination with the accompanying drawings. It is noted herein that the descriptions of these embodiments are intended to aid in the understanding of the present invention but do not constitute restriction on the present invention. In addition, the technical features involved in the various embodiments of the present invention described below may be combined with each other as long as they do not constitute a conflict with each other.

Embodiments

As shown in FIG. 1, a control method for signal transmission through voltage boosting comprises:

step S1, processing an input low-voltage signal by a low-voltage signal processing circuit 2, and outputting a low-voltage control signal to a modulation module 3; and performing voltage processing on an input power supply by a supply voltage processing circuit 1, and outputting two sets of DC power supplies having voltage difference therebetween to the modulation module 3;

step S2, modulating, by the modulation module 3, the low-voltage control signal and the DC power supplies to generate a high-voltage LED signal; and step S3, performing high-voltage signal processing on the high-voltage LED signal by a high-voltage LED signal processing circuit 4, and outputting an LED control signal and an LED power supply which are mutually independent.

Particularly, in the step S3, the high-voltage LED signal processing circuit 4 performs demodulation processing on the high-voltage LED signal, and then outputs the LED control signal and the LED power supply.

Figure 2:
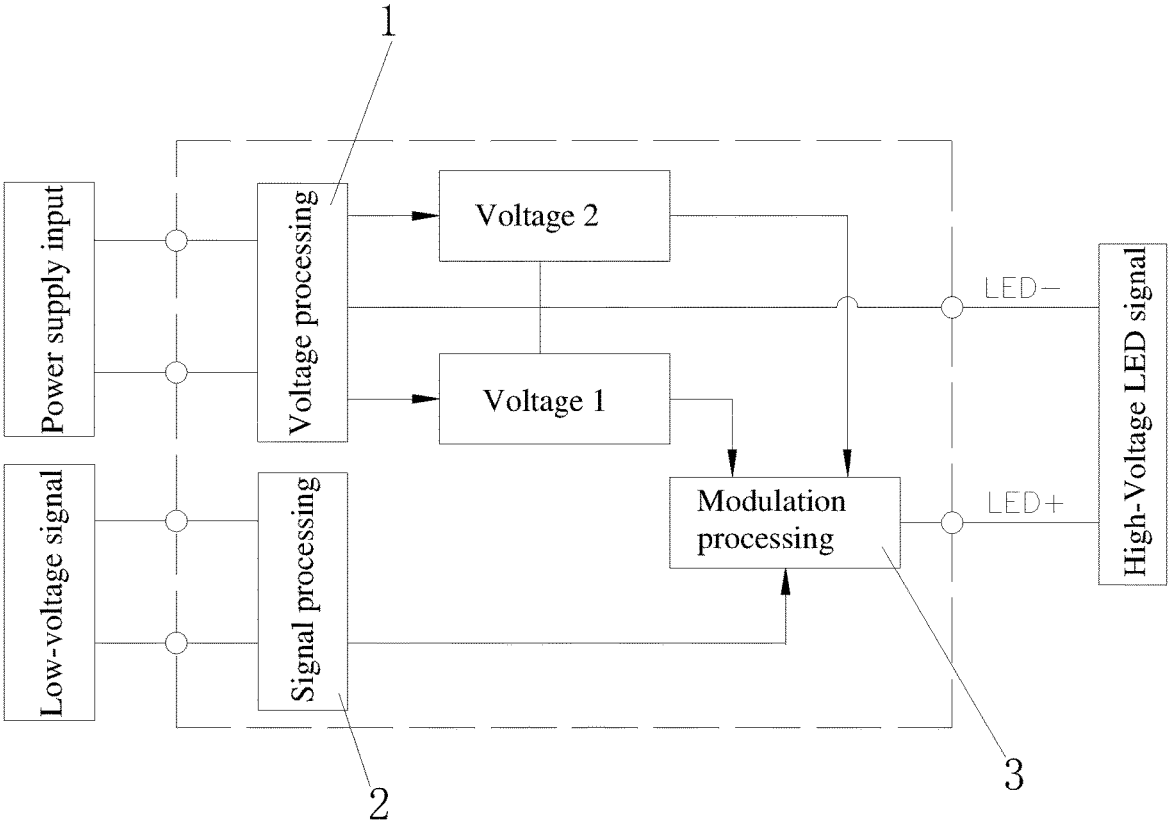
FIG. 2 is a structural block diagram of a high-voltage LED signal modulation circuit in accordance with an embodiment of the present invention.
Figure 3:
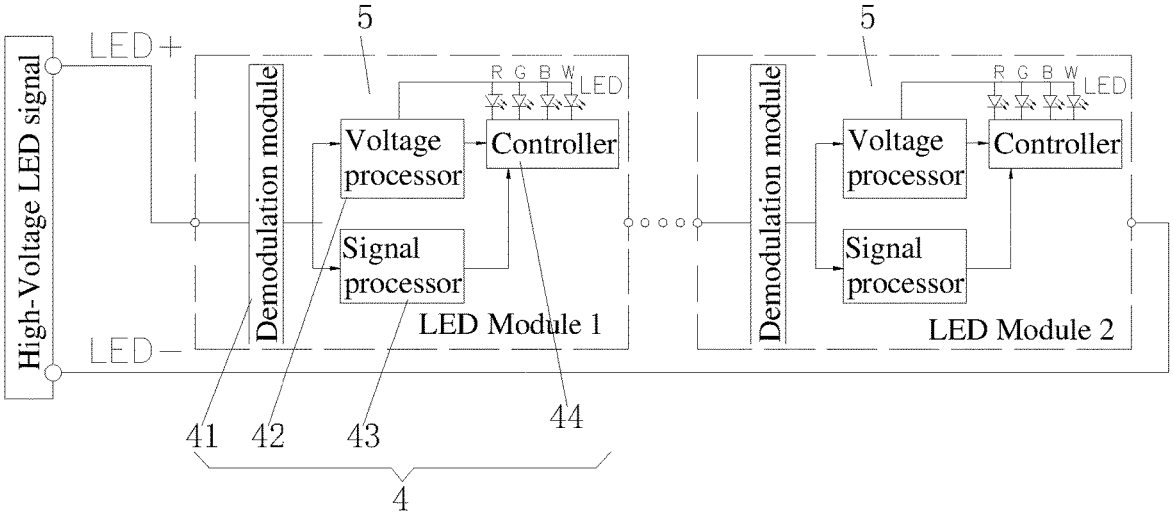
FIG. 3 is a structural block diagram of a high-voltage LED signal processing circuit in accordance with the embodiment of the present invention.
Figure 4:
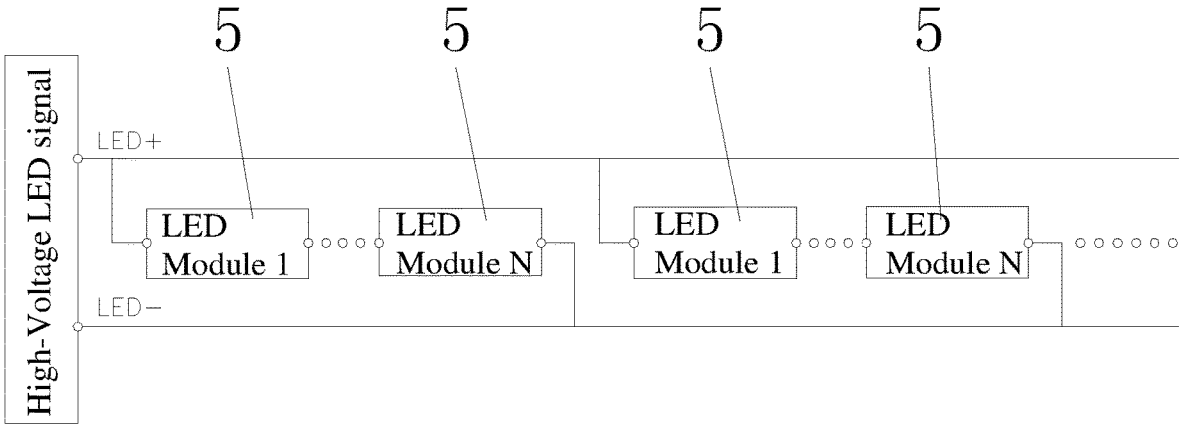
FIG. 4 is a schematic block diagram of a lamp string circuit in accordance with the embodiment of the present invention.

As shown in FIGS. 2-4, the above-mentioned method for signal transmission through voltage boosting is applied to an application circuit for controlling light emission of lamp strings, the application circuit comprising:

a supply voltage processing circuit 1 for receiving a power supply, and performing voltage processing on the power supply input signal and outputting a first DC power supply and a second DC power supply;

a low-voltage signal processing circuit 2 for receiving a low-voltage signal, and processing the low-voltage signal and outputting a low-voltage control signal;

a modulation module 3 electrically connected to the supply voltage processing circuit and the low-voltage signal processing circuit, respectively, for modulating the low-voltage control signal and the first and second DC power supplies into a high-voltage LED signal; and a high-voltage LED signal processing circuit 4 electrically connected to the modulation module 3, for performing demodulation processing on the high-voltage LED signal, and outputting an LED control signal and an LED power supply which are mutually independent.

Particularly, the voltage of the first DC power supply is different from that of the second DC power supply, thus forming high and low voltage levels.

The signal characteristics of the high-voltage LED signal are the same as those of the low-voltage signal.

The high-voltage LED signal processing circuit comprises a demodulation module 41, a voltage processor 42, a signal processor 43 and a controller 44, wherein the demodulation module 41 is electrically connected to and in cooperation with the modulation module 3 and separates the high-voltage LED signal into an LED power supply and an LED control signal, the LED power supply being processed by the voltage processor and then entering into the LED controller, and the LED control signal being processed by the signal processor and then entering into the LED controller to control the change in light emission of LED lamps.

The high-voltage LED signal processing circuit is packaged in an LED module or integrated in an integrated circuit. Several said LED modules are connected in series or in parallel to form a lamp string.

The embodiments of the present invention are described in detail above in combination with the drawings, but the present invention is not limited to the described embodiments. For a person skilled in the art, various changes, modifications, substitutions and variants of these embodiments still fall within the scope of protection of the present invention without departing from the principles and spirit of the present invention.

The invention claimed is:

1. A control method for signal transmission through voltage boosting, comprising:

step s1, processing an input low-voltage signal by a low-voltage signal processing circuit, and outputting a low-voltage control signal to a modulation module; and performing voltage processing on an input power supply by a supply voltage processing circuit, and outputting two sets of DC power supplies having voltage difference therebetween to the modulation module;

step s2, modulating, by the modulation module, the low-voltage control signal and the two sets of DC power supplies having voltage difference therebetween to generate a high-voltage LED signal of which the voltage is higher than that of the low-voltage signal; and step s3, performing high-voltage signal processing on the high-voltage LED signal by a high-voltage LED signal processing circuit, and outputting an LED control signal and an LED power supply which are mutually independent.

2. The control method of claim 1, wherein in the step s3, after performing high-voltage signal demodulation processing on the high-voltage LED signal by a high-voltage LED signal processing circuit, outputting the LED control signal and the LED power supply to control LEDs.

3. An application circuit for signal transmission through voltage boosting, comprising:

a voltage processing circuit for receiving a power supply, and performing voltage processing on the power supply and outputting a first DC power supply and a second DC power supply having voltage difference therebetween;

a low-voltage signal processing circuit for receiving a low-voltage signal, and processing the low-voltage signal and outputting a low-voltage control signal suitable for processing by a modulation module;

the modulation module electrically connected to the voltage processing circuit and the low-voltage signal processing circuit, respectively, for modulating the low-voltage control signal and the first and second DC power supplies into a high-voltage LED signal; and a high-voltage LED signal processing circuit electrically connected to the modulation module, for performing demodulation processing on the high-voltage LED signal, and outputting an LED control signal and an LED power supply which are mutually independent.

4. The application circuit of claim 3, wherein the voltage of the first DC power supply is different from that of the second DC power supply, and the voltage of the high-voltage LED signal is higher than that of the low-voltage signal.

5. The application circuit of claim 3, wherein the signal characteristics of the high-voltage LED signal are the same as those of the low-voltage signal.

6. The application circuit of claim 3, wherein the high-voltage LED signal processing circuit comprises a demodulation module, a voltage processor, a signal processor and a controller, wherein the demodulation module is electrically connected to and in cooperation with the modulation module and separates the high-voltage LED signal into an LED power supply and an LED control signal, the LED power supply being processed by the voltage processor and then entering into the LED controller, and the LED control signal being processed by the signal processor and then entering into the LED controller to control the change in light emission of LED lamps.

7. The application circuit of claim 6, wherein the high-voltage LED signal processing circuit is packaged in an LED module or integrated in an integrated circuit.

8. The application circuit of claim 7, wherein a plurality of the LED modules are connected in series or in parallel to form a lamp string.

* * * * *